US010060345B2

(12) United States Patent
Exner et al.

(10) Patent No.: US 10,060,345 B2
(45) Date of Patent: Aug. 28, 2018

(54) DUAL CRANKSHAFT, OPPOSED-PISTON ENGINE CONSTRUCTIONS

(75) Inventors: Christina Exner, San Diego, CA (US); James U. Lemke, La Jolla, CA (US)

(73) Assignee: ACHATES POWER, INC., San Diego, CA (US)

( * ) Notice: Subject to any disclaimer, the term of this patent is extended or adjusted under 35 U.S.C. 154(b) by 0 days.

(21) Appl. No.: 13/385,539

(22) Filed: Feb. 23, 2012

(65) Prior Publication Data

US 2012/0285422 A1 Nov. 15, 2012

Related U.S. Application Data

(60) Provisional application No. 61/463,816, filed on Feb. 23, 2011.

(51) Int. Cl.
*F02B 75/28* (2006.01)

(52) U.S. Cl.
CPC ..... *F02B 75/282* (2013.01); *F02B 75/28* (2013.01)

(58) Field of Classification Search
CPC ..... F02B 75/28; F02B 75/282
USPC ..... 123/51 A, 51 R, 51 AA
See application file for complete search history.

(56) References Cited

U.S. PATENT DOCUMENTS

| | | | | |
|---|---|---|---|---|
| 3,485,221 | A * | 12/1969 | Feeback | 123/51 AA |
| 4,037,572 | A * | 7/1977 | Franz | 123/64 |
| 4,321,893 | A | 3/1982 | Yamamoto | |
| 4,876,992 | A | 10/1989 | Sobotowski | |
| 5,058,536 | A | 10/1991 | Johnston | |
| 6,386,066 | B1 | 5/2002 | Shotwell | |
| 7,568,453 | B2 | 8/2009 | Angstrom | |
| 2005/0274332 | A1* | 12/2005 | Lemke et al. | 123/41.35 |
| 2009/0266339 | A1* | 10/2009 | Cleeves | 123/48 R |
| 2010/0071671 | A1* | 3/2010 | Lemke | 123/51 R |
| 2010/0282219 | A1* | 11/2010 | Alonso | 123/51 AA |

* cited by examiner

*Primary Examiner* — Jacob Amick
(74) *Attorney, Agent, or Firm* — Terrance A. Meador

(57) ABSTRACT

A dual-crankshaft, opposed-piston, internal combustion engine includes one or more ported cylinders. Each cylinder has exhaust and intake ports, and the cylinders are juxtaposed and oriented with exhaust and intake ports mutually aligned. The crankshafts are rotatably mounted at respective exhaust and intake ends of the cylinders and are coupled by a multi-gear train. A pair of pistons is disposed for opposed sliding movement in the bore of each cylinder. All of the pistons controlling the exhaust ports are coupled by connecting rods to the crankshaft mounted near at the exhaust ends of the cylinders, and all of the pistons controlling the intake ports are coupled by connecting rods to the crankshaft mounted near at the intake ends of the cylinders. The crankshafts are connected by a timing belt operative to change the rotational timing between the crankshafts. The gear train support structure is stiffened to suppress gear train vibration.

3 Claims, 6 Drawing Sheets

DUAL CRANKSHAFT, OPPOSED-PISTON ENGINE CONSTRUCTIONS

PRIORITY

This application claims priority to U.S. Provisional Application for Patent No. 61/463,816, filed Feb. 23, 2011.

BACKGROUND

The subject matter relates to a dual-crankshaft, opposed-piston engine with improvements for variable port timing and gear train resonance reduction. More particularly, the subject matter relates to an opposed-piston engine with two crankshafts coupled by a gear train, in which the crankshafts are coupled together by a timing control mechanism that acts between the crankshafts to vary the timing of port operations in the engine. In other aspects, the subject matter relates to an opposed-piston engine with two crankshafts coupled by a gear train, in which vibration of the gear train occurring at various engine speeds is reduced.

In an opposed-piston engine, a pair of pistons is disposed for opposed sliding motion in the bore of at least one ported cylinder. Each cylinder has exhaust and intake ports, and the cylinders are juxtaposed and oriented with exhaust and intake ports mutually aligned. Of two crankshafts, one each is rotatably mounted at respective exhaust ends and intake ends of the cylinders, and each piston is coupled to drive a respective one of the two crankshafts. The reciprocal movement of each piston in the cylinder controls the operation of a respective one of the two ports formed in the cylinder's sidewall. Each port is located at a fixed position where it is opened and closed by a respective piston at predetermined points during each cycle of engine operation.

It is desirable to be able to vary the timing of port openings and closings during engine operation in order to dynamically adapt the time that a port remains open to changing speeds and loads that occur during engine operation. The objective is to maximize the amount of air trapped in the cylinder during the compression stroke during various phases of engine operation.

In a dual-crankshaft, opposed-piston engine architecture, the trapped compression ratio (trapped CR) can be varied by adjusting the phase offset between the exhaust and intake crankshafts. Increasing the exhaust crank lead from a nominal value results in decreasing the trapped compression ratio along with a corresponding increase in the exhaust blowdown time-area, that is, the time-integrated area that the exhaust port is open before the intake port opens. Conversely, decreasing the exhaust crank lead results in increasing the trapped compression ratio along with a corresponding decrease in the exhaust blowdown time-area.

Concurrently decreasing the trapped compression ratio and increasing the exhaust blowdown time-area is advantageous for standard engine operation at high engine speeds and high engine loads. At these conditions, lower trapped compression ratios are typically desired because of NOx emission considerations (lower CR typically leads to lower NOx emission), while larger blowdown time-areas are required because of the decreased wall-clock time available to blow down the cylinder contents into the exhaust manifold prior to the intake ports opening.

Similarly, the concurrently increasing trapped compression ratio and decreasing exhaust blowdown time-area is advantageous at lower speeds and lower loads, where higher compression ratios are advantageous for cold-start and engine efficiency considerations and where less exhaust blowdown time-area is required.

SUMMARY

One way to change the port timing in a cylinder of an opposed-piston engine is to advance or retard the operational cycle of at least one of the opposed pistons. The change acts to produce a shift in the timings of the openings and closings of the port controlled by the piston with respect to the engine operating cycle. In particular, the timing between the crankshafts is varied in order to obtain a change in timing between the movements of the opposed pistons.

In a dual-crankshaft, opposed-piston engine architecture, gear wheels are mounted to the crankshafts, and the rotations of the crankshafts are transmitted through a gear train including a plurality of intermediate gear wheels. A gear train can produce gear vibration. The vibration can be aggravated by an unequal distribution of power transmitted by the crankshafts, a rotational phase difference between the crankshafts, and operation of auxiliary devices from the lower-powered crankshaft. As is known, gear train vibration produces noise and high impact loads on gear teeth, and reduces gear bearing life.

It is desirable to be able to reduce gear train vibrations in order to reduce engine noise and to extend the useful lifetime of gear wheels and gear bearings. An objective in this regard is to adapt the layout and construction of gear train and gear bearing support elements for reduction or suppression of dynamic behavior of the gear train.

One way to reduce or eliminate vibrations in the gear train of an opposed-piston engine is to stiffen the structures which support gear train and gear bearing support elements.

BRIEF DESCRIPTION OF THE DRAWINGS

The drawings illustrate modifications of a dual-crank, opposed-piston engine equipped with a mechanism for varying port timing by varying the timing between the crankshafts.

The drawings also illustrate modifications of a dual-crank, opposed-piston engine equipped with a stiff gear housing for reducing or eliminating gear train vibrations.

SPECIFICATION

Figure 1:
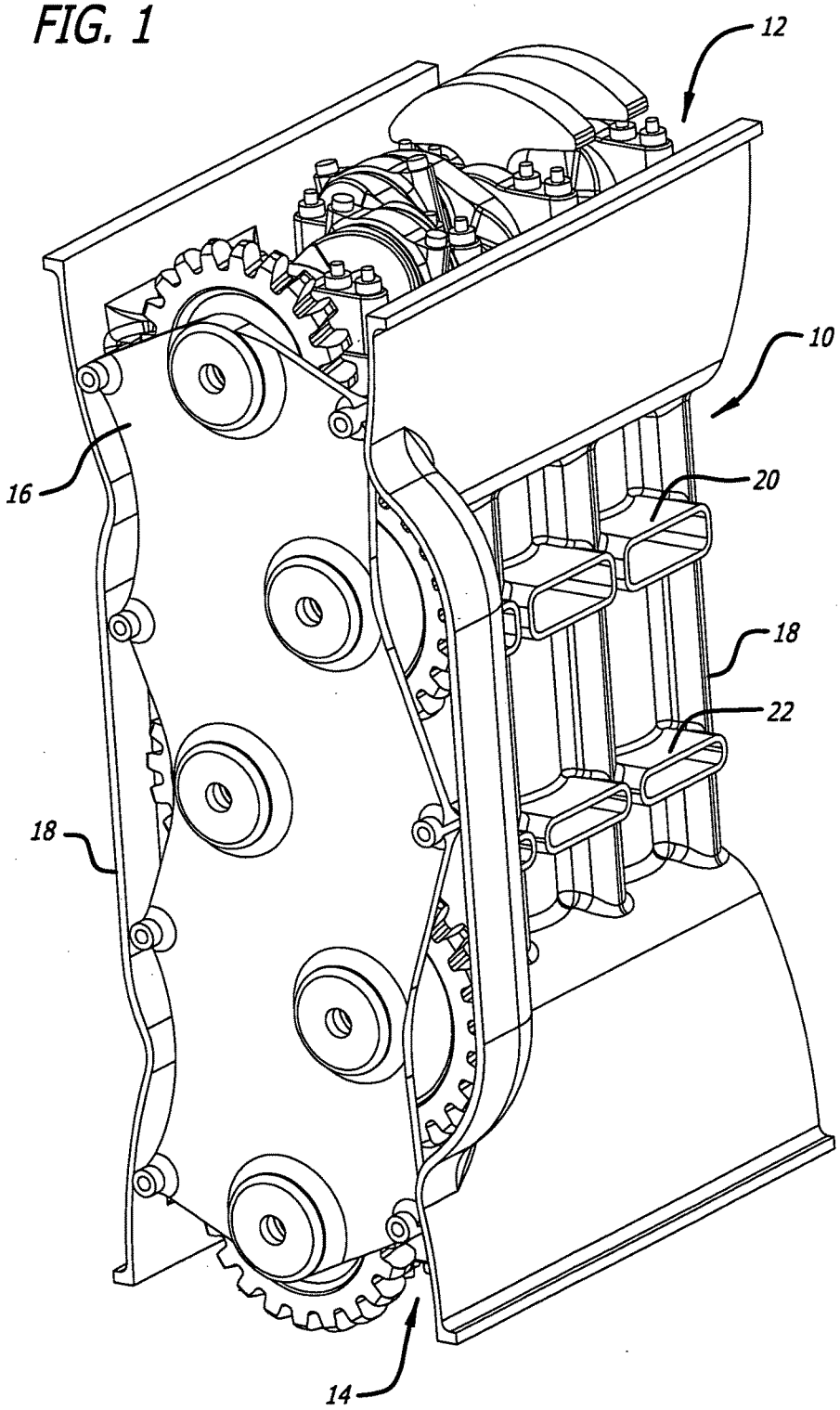
FIG. 1 is an isometric view of a dual-crank, opposed-piston, internal combustion engine, partially disassembled.
Figure 2:
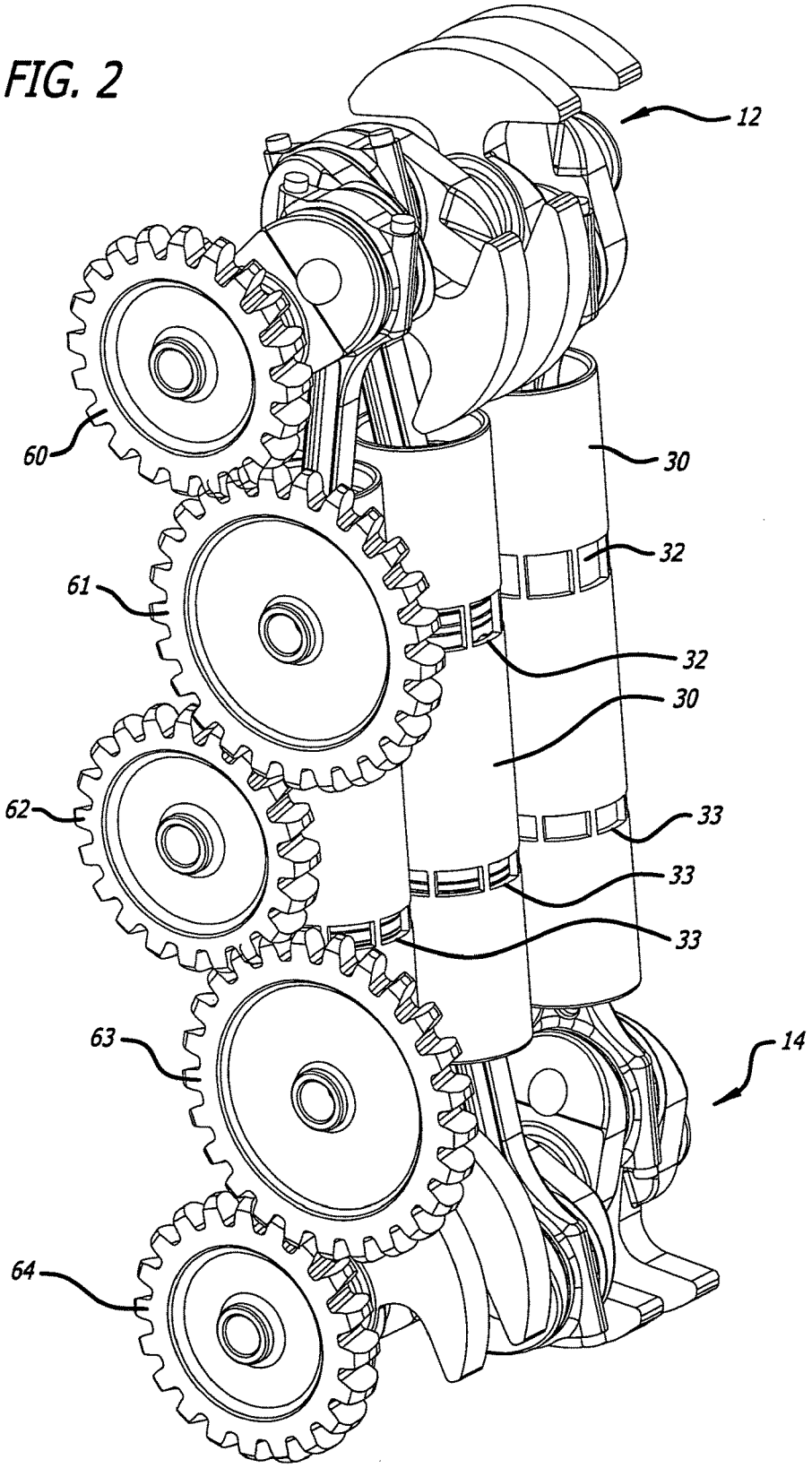
FIG. 2 is an isometric view of the opposed-piston engine of FIG. 1, with casing parts removed to show ported cylinders.
Figure 3:
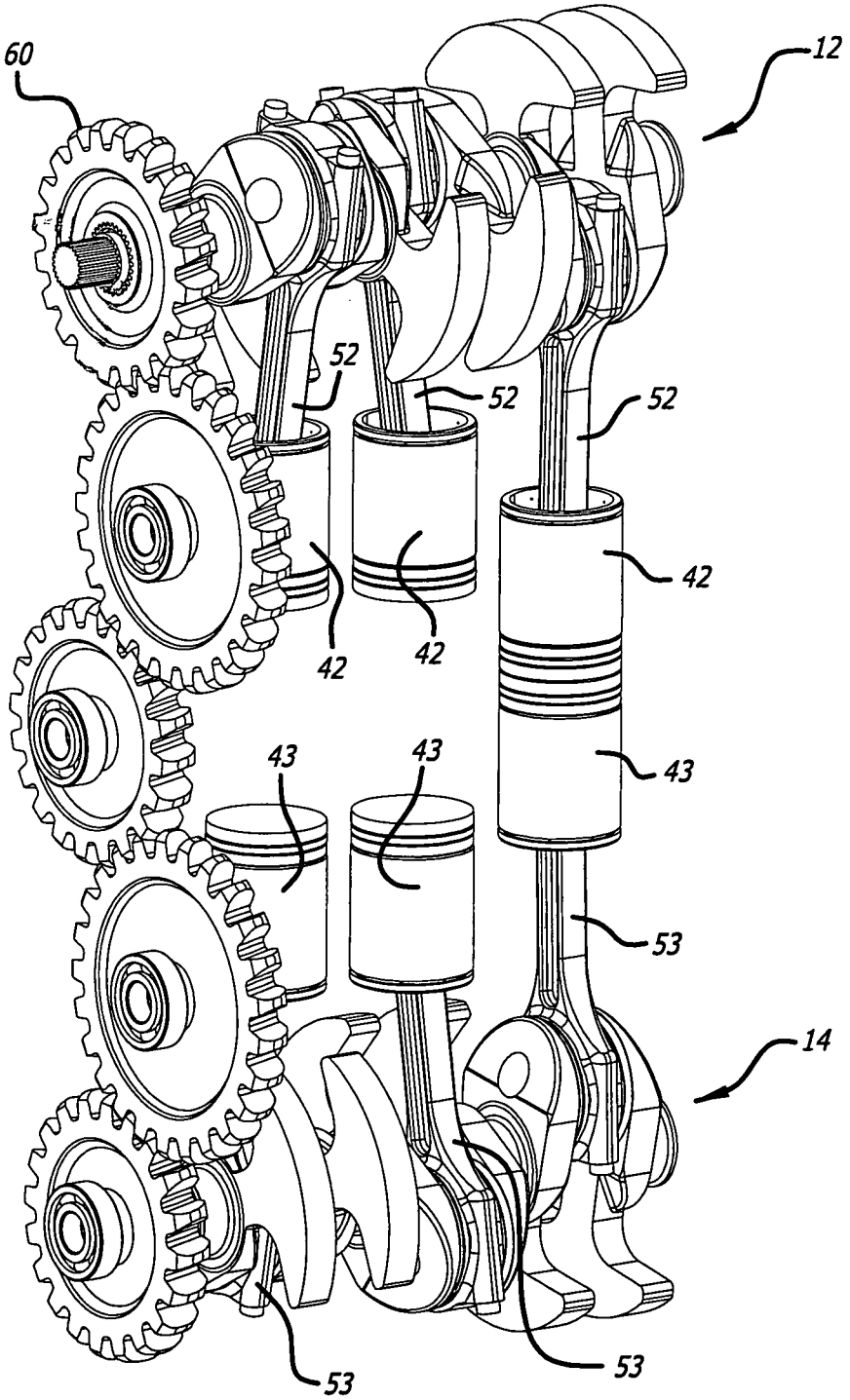
FIG. 3 is an isometric view of the opposed-piston engine of FIG. 1, with cylinders removed to show pistons.

Dual-Crankshaft, Opposed-Piston Engine Construction:

FIG. 1 illustrates a partially constructed dual-crankshaft, opposed-piston, internal combustion engine 10 with two crankshafts 12 and 14. An end panel 16 supports a gear train that connects the crankshafts. Side panels 18 include exhaust and intake channels 20 and 22 that communicate with exhaust and intake ports of one or more cylinders. Referring to FIGS. 2 and 3, the engine includes one or more ported cylinders 30. For example, the engine can include one, two, three, or more cylinders. Each cylinder 30 has exhaust and intake ports 32 and 33, and the cylinders 30 are juxtaposed and oriented with exhaust and intake ports mutually aligned. The crankshafts 12 and 14 are rotatably mounted at respective exhaust and intake ends of the cylinders 30, and so the crankshafts 12 and 14 can be respectively indicated as the exhaust crankshaft 12 and the intake crankshaft 14. A pair of pistons 42, 43 is disposed for opposed sliding movement in the bore of each cylinder 30. All of the pistons 42 controlling the exhaust ports 32 are coupled by connecting rods to 52 the exhaust crankshaft 12; all of the pistons 43 controlling the intake ports 33 are coupled by connecting rods 53 to the intake crankshaft 14. The crankshafts 12 and 14 are connected by a gear train including the gears 60-64. Preferably, each of the cranks on the exhaust crankshaft 12 leads the crank coupled to the same cylinder 30 of the intake crankshaft 14 by a predetermined angle Ø. Preferably, although not necessarily, driving power is taken from the exhaust crankshaft 12, while the intake crankshaft 14 is coupled to run auxiliary devices such as pumps, a supercharger, and a compressor.

Crankshaft Timing Adjustment:

The engine architecture illustrated in FIGS. 1-3, is modified to equip the engine with a timing adjustment mechanism operative to change the rotational timing between the crankshafts, thereby to change the timing of exhaust and/or intake port timing. A preferred modification is illustrated in FIG. 4.

Figure 4:
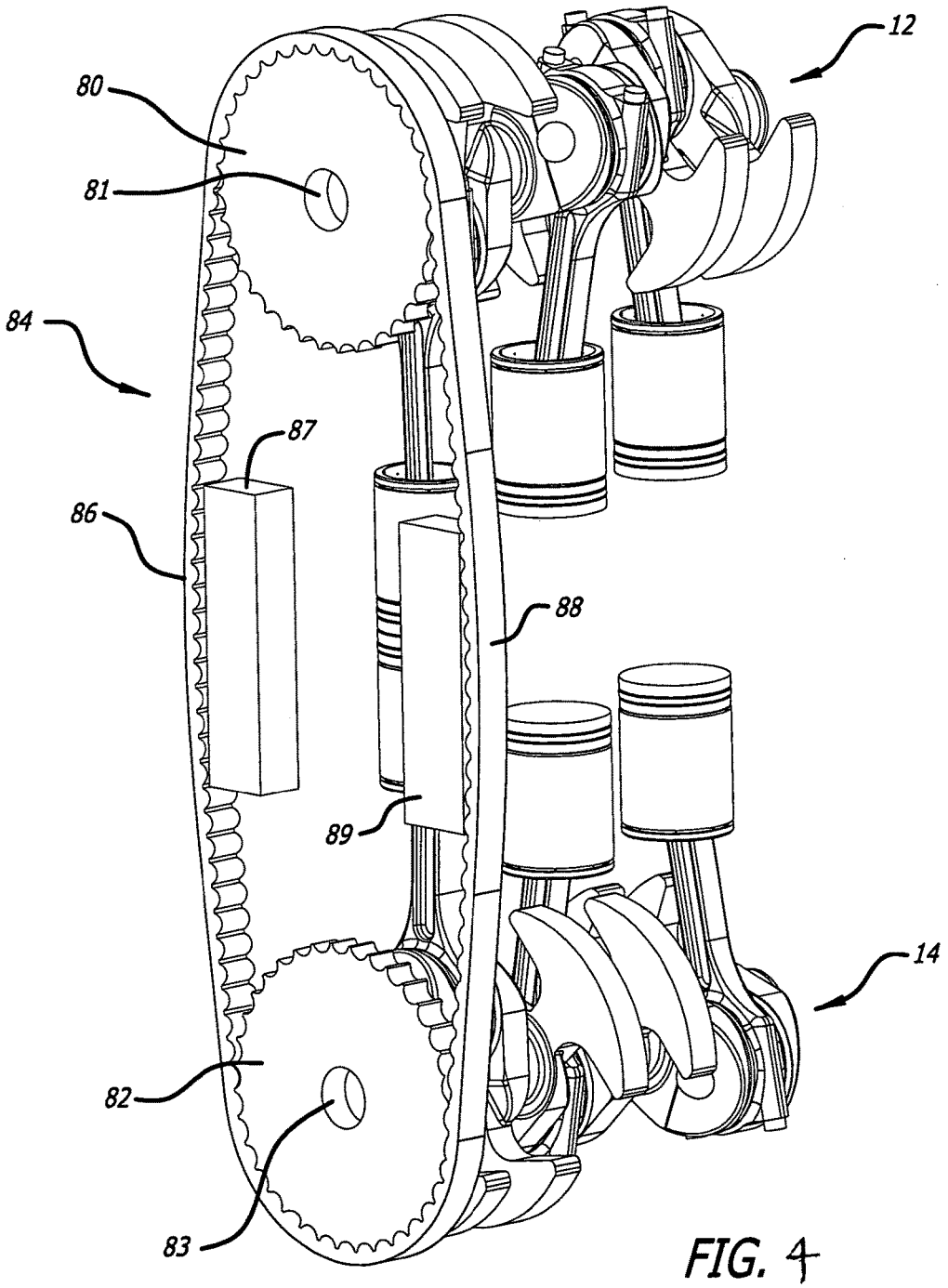
FIG. 4 is an isometric view of the opposed-piston engine of FIG. 3 showing an embodiment of a timing adjustment mechanism operative to change the rotational timing between the crankshafts.

Construction to Vary Port Timing:

In FIG. 4 the isometric view of FIG. 3 is rotated by 180° to show a modification applied to the end of the engine opposite where the gear train would be. As per this view, sprockets 80 and 82 mounted to the ends 81 and 83 of the crankshafts 12 and 14. The sprockets 80 and 82 are connected by a chain 84. A first span 86 of the chain is tensioned by a tensioner 87; a second span 88 is tensioned by a tensioner 89. By changing the positions of the tensioners 87 and 89, the lengths of the spans 86 and 88 are varied, thereby varying the predetermined angle Ø between the exhaust and intake crankshafts 12 and 14.

Figure 5:
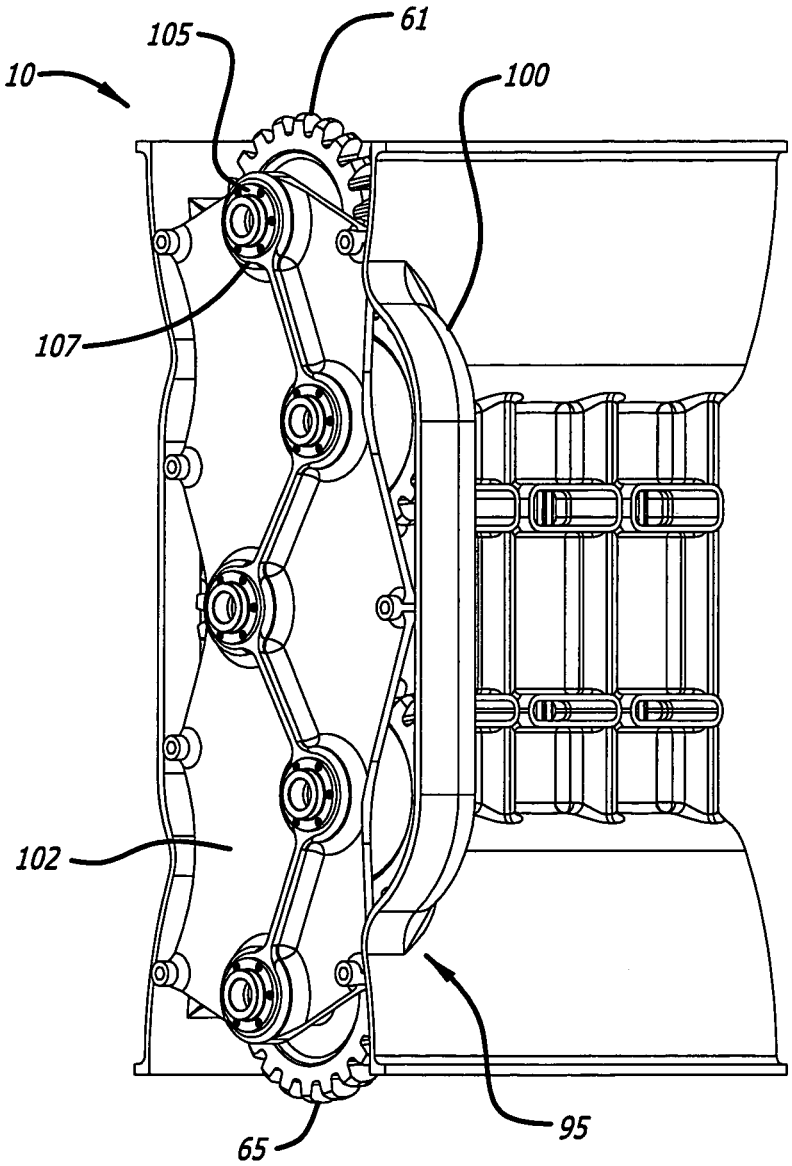
FIG. 5 is an isometric view of a dual-crank, opposed-piston, internal combustion engine, partially disassembled, showing a stiffened gear train housing.
Figure 6:
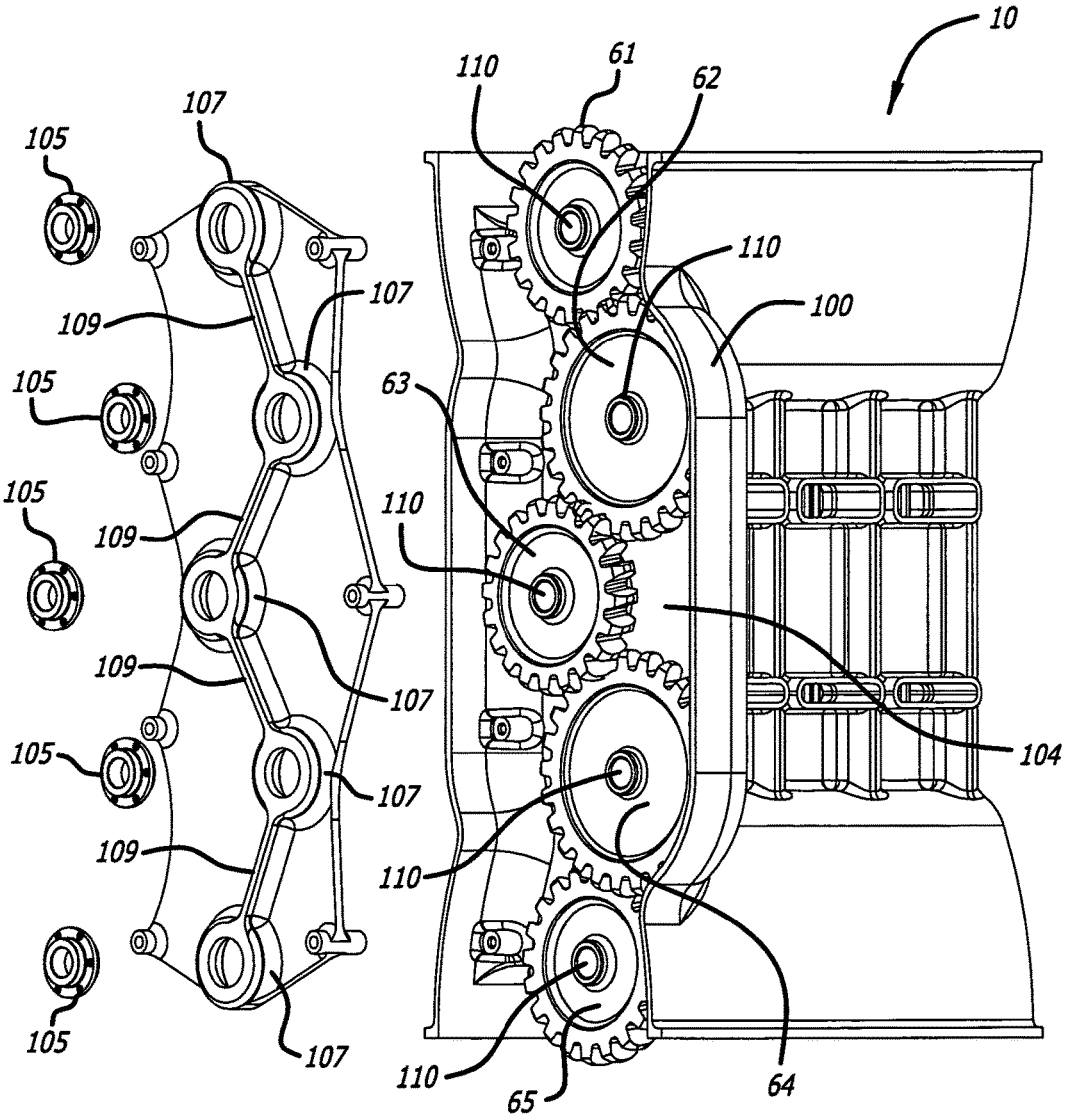
FIG. 6 is an exploded isometric view of a dual-crank, opposed-piston, internal combustion engine, partially disassembled, showing a gear train housing construction that stiffens both gear support and gear bearing support.

Elimination of Gear Train Vibration:

FIG. 5 illustrates the partially constructed dual-crankshaft, opposed-piston, internal combustion engine 10 with two crankshafts 12 and 14 of FIG. 1, with modifications to the gear train support structure that contribute to the reduction or elimination of gear train vibration by stiffening gear support elements; FIG. 6 illustrates the modified engine 10 with elements of the gear train support structure exploded. In this regard, a gear train housing 98 includes a gear train container 100 closed by a cover 102 bolted thereto. Each of the gears 61-65 is disposed for rotation in the housing 98, by a bearing (not seen in these figures) in the back panel 104 of the container 100 and a bearing 105 in the cover 102. Preferably, the gear train container 100 and the engine crankcase are formed in one piece of a stiff material such as cast steel or cast iron. If a lower engine weight is desired, it is preferred to change the material locally in order to stiffen the gear and bearing support locally. For example, if the bearing container 100 and the engine are cast from aluminum or an aluminum alloy, it is preferable to support the gear bearings 105 by cast or steel inlays 107 around the bearing locations of the cover 102, and to similarly support the gear bearings in the back panel 104 of the container. Additionally, local stiffening of the cover 102 provided by ribs 109 (or beading) adds support to stiffen the bearing shafts 110. The design of the gear bearings also maintains a minimum distance between the bearing locations on either side of each gear in order to minimize bending effects. Larger, hollow gear shafts also contribute to increased stiffness. Any one or more of these elements increases the stiffness of the gear train support structure of the engine 10, which leads to reduction, if not elimination, of gear train vibration. Of course, in addition to these measures, the incorporation of one or more anti-backlash mechanisms to the gear train will also contribute to suppression of gear train vibration.

Although principles of exhaust and/or intake port timing variation have been described with reference to presently preferred embodiments, it should be understood that various modifications can be made without departing from the spirit of the described principles. Accordingly, the principles are limited only by the following claims.

The invention claimed is:

1. An opposed-piston, internal combustion engine including one or more ported cylinders that are juxtaposed and oriented with exhaust and intake ports mutually aligned, a pair of crankshafts rotatably mounted at respective exhaust and intake ends of the cylinders, and a pair of pistons disposed for opposed sliding movement in the bore of each cylinder, all of the pistons controlling the exhaust ports being coupled by connecting rods to a first crankshaft mounted at the exhaust ends of the cylinders, and all of the pistons controlling the intake ports being coupled by connecting rods to a second crankshaft mounted at the intake ends of the cylinders, in which the crankshafts are connected by a gear train contained in a stiffened gear train housing, the stiffened gear train housing comprising:

a gear train container with a back panel;

a removable cover bolted to the gear train container; and, gear bearing support apertures in the removable cover;

wherein the removable cover includes ribs extending between the gear bearing support apertures;

each gear of the gear train being disposed for rotation in the gear train housing by a bearing in the back panel and a bearing in a gear bearing support aperture in the removable cover.

2. The opposed-piston, internal combustion engine of claim 1, in which the gear train container is cast in one with an engine block.

3. The opposed-piston, internal combustion engine of claim 2, in which the gear train container is formed from one of cast iron or cast steel.

* * * * *